US008015665B2

(12) United States Patent
Pan

(10) Patent No.: US 8,015,665 B2
(45) Date of Patent: Sep. 13, 2011

(54) SPRING HINGE

(76) Inventor: Jiaoting Pan, Zhejiang (CN)

( * ) Notice: Subject to any disclaimer, the term of this patent is extended or adjusted under 35 U.S.C. 154(b) by 354 days.

(21) Appl. No.: 12/109,759

(22) Filed: Apr. 25, 2008

(65) Prior Publication Data

US 2009/0265889 A1 Oct. 29, 2009

(51) Int. Cl.
*E05F 3/20* (2006.01)

(52) U.S. Cl. ..... 16/50; 16/52; 16/54; 16/58; 16/75; 16/308

(58) Field of Classification Search ..... 16/50, 52, 16/54, 58, 75, 308; 267/205, 208, 215, 201, 267/202; 188/130, 381
See application file for complete search history.

(56) References Cited

U.S. PATENT DOCUMENTS 3,401,422 A * 9/1968 Ventura ..... 16/54
4,068,344 A * 1/1978 Okabe ..... 16/54
4,155,144 A * 5/1979 Koganei ..... 16/54
4,325,164 A * 4/1982 Sasaki ..... 16/55
6,205,619 B1 * 3/2001 Jang ..... 16/352
2009/0241289 A1 * 10/2009 Choi et al. ..... 16/275

* cited by examiner

*Primary Examiner* — Thomas B Will
*Assistant Examiner* — Emily Morgan

(57) ABSTRACT

A spring hinge comprises a frame leaf, door leaf, upper and lower tube sections to fixedly connect with frame leaf, and middle tube section to fixedly connect with door leaf, wherein middle tube section is internally made with a hydraulic damping speed reducing device; lower tube section is internally installed with a torsion spring device, wherein torsion spring being completely sleeved on the exterior of spindle rod is affixed to the spring seat at the lower end thereof, and an upper and lower clutching device is installed between middle tube section and torsion spring device thereby allowing middle tube section and torsion spring device to be separated or combinedly moved, wherein torsion spring and hydraulic damping speed reducing device are packagely used to close door slowly while releasing spring energy after closing to set angle to precisely close the door.

16 Claims, 10 Drawing Sheets

SPRING HINGE

BACKGROUND OF THE INVENTION (a) Field of the Invention

The invention is related to a hinge, more particularly to a spring hinge.

(b) Description of the Prior Art

Currently, most doors are installed with spring hinges of automatic door closing function. However, as these spring hinges are not attached with speed reducing devices, the door closing speed during the automatic recovery process after door open is usually very fast thus causing big impact on the door frame with loud noise. Further, wind resistance phenomenon usually occurs when door is closed to a small angle thus causing door lock unable to lock precisely to affect precision of door close.

SUMMARY OF THE INVENTION

The present invention is purposed to disclose a spring hinge capable of closing the door with a slowerable speed and a precise locking aiming to resolve the imperfections of existing arts.

To realize above said purpose, the present invention discloses a spring hinge which comprises a frame leaf, door leaf, upper and lower tube sections to fixedly connect with frame leaf, and the middle tube section to fixedly connect with door leaf, wherein middle tube section is internally made with a hydraulic damping speed reducing device which is characterized in that the lower tube section is internally installed with a torsion spring device comprising a torsion spring and its spring seat as well as spindle rod, wherein torsion spring being completely sleeved on the exterior of spindle rod is affixed to the spring seat at the lower end thereof, and an upper and lower clutching device is installed between middle tube section and torsion spring device thereby allowing middle tube section and torsion spring device to be separated or combinedly moved.

The present invention is further to disclose an upper and lower clutching device which comprises the axially installed upper clutch seat, middle clutch seat, and lower clutch seat, wherein upper clutch seat is fixedly connected with oil seal of middle tube section at one end thereof and is attached to middle clutch seat, wherein middle clutch seat is radially symmetrically made with two ball holes, and each hole contains two matching steel balls, the sum of diameters of the two steel balls is larger than the thickness of middle clutch seat, and the contact surfaces between upper clutch seat and lower clutch seat are respectively made with ball cavities to match with steel balls thereon, while depth of ball cavity is smaller than radius of steel ball; further, upper clutch seat is fixedly connected with middle tube section, wherein middle clutch seat and lower clutch seat are sleeved on spindle rod, and middle clutch seat is fixedly connected with spindle rod while lower clutch seat is movably connected with spindle rod; upper clutch seat and lower clutch seat are respectively misalignedly rotationally engaged thereby allowing middle tube section and torsion spring device to be separated or combinedly moved.

The present invention is further to disclose a hydraulic damping speed reducing device which comprises plunger, plunger rod, speed adjusting rod, and plunger rod connecting sleeve, wherein plunger is movably sleevedly inserted into middle tube section thereby forming the radial linkage connection as well as axial sliding and dynamic sealing engagement; the plunger is internally formed to an inner threaded cavity and is made with oil cavities respectively at the upper and lower ends thereof and is further made with the oil inlet and oil outlet at lower end portion thereof, wherein oil outlet is formed with an unidirectional valve, and plunger rod connecting sleeve is affixed to tube wall of middle tube section, wherein upper end of plunger rod being movably sleevedly inserted into plunger rod connecting sleeve and formed with external thread at lower end thereof is inserted into the inner cavity of plunger thereby allowing plunger and plunger rod to form threaded engagement; the plunger rod or plunger is centrally penetratingly made with an oil path which is connected with the upper and lower oil cavities; further, the speed adjusting rod being a long spindle is contained inside oil path and is inserted into oil inlet of plunger at the lower end thereof to form adjustable clearance engagement, upper tube section has an openable top end cover, and the adjustable end of speed adjusting rod below the top end cover.

The present invention is further to disclose that the plunger is radially peripherally uniformly made with multiple guide rails on the external wall thereof, and middle tube section is radially formed with multiple guide grooves on the inner wall thereof to match with guide rails thereby allowing plunger and inner wall of middle tube section to form above said radial linkage connection and axial sliding engagement.

The invention is further to disclose that the plunger rod is made with radially uniformly distributed multiple rack gear type guide rail on the top part thereof and a gear type fixed element is correspondingly provided above top end of plunger rod, gear type fixed element is internally ringly formed with gear type grooves to match with gear type guide rail of plunger thereby making guide rails and guide grooves engaged, and the gear type fixed element is further externally ringly formed with radially uniformly distributed multiple gear members thereon to engage with multiple gear grooves being correspondingly made on inner tube wall of upper tube section, wherein number the outer ring gear members and number inner ring gear type grooves of gear type fixed element constitute a corresponding relationship.

The present invention is further to disclose that the plunger rod is centrally penetratingly made with an oil path and is made with a small oil hole in connection with the inner oil path thereof at a position on the external wall thereof relative to oil cavity, the oil inlet of plunger is centrally located at bottom of plunger to align with said oil path to appear a straight line, and the speed adjusting rod is contained inside oil path of plunger rod.

The invention is further to disclose that the middle tube section below lower oil cavity is installed with a magnet at the bottom thereof relative to the plunger.

The present invention is further to disclose that the upper clutch seat is installed with multiple rollers radially uniformly distributed on the external wall thereof to frictionably engage with inner wall of lower tube section, and plunger rod connecting sleeve is installed with multiple said rollers radially uniformly distributed on the external wall thereof to frictionally engage with inner wall of middle tube section.

The present invention is further more to disclose that a steel ball force bearing device being installed between said middle tube section and lower tube section comprises steel balls, and the bearing ball retainer being made at bottom of middle tube section having multiple radially uniformly distributed steel balls Comparing with existing spring hinge, the present invention is further installed with a hydraulic damping speed reducing device and a torsion spring device; when door is opened, the plunger is moved upwardly to push oil inside upper oil cavity to lower oil cavity via unidirectional valve, wherein unidirectional valve makes oil flow rapidly without producing resistance. when door is closed, plunger is moved downwardly to push oil inside upper oil cavity to lower oil cavity, whereas unidirectional valve is closed, oil can only enter from oil outlet and flow out from small oil hole, and since the engaged clearance between speed adjusting rod and oil outlet is small making oil flow slowly thus producing a damping force to resist plunger thereby allowing the door to be closed at a stable speed; when the door is opened within set angle range, the torsion spring device being installed inside lower tube section is driven to accumulate energy and stopped to accumulate energy when the set angle range is exceeded. When the door is closed to the set angle degree, torsion spring starts to release energy thus ensuring a sufficient large force to close the door at final closing and lock in precisely, wherein torsion spring and hydraulic damping speed reducing device are packagely used in the door closing process to allow the door to be slowly closed to a set angle of 15-20 degrees in general, then torsion spring releases energy to precisely close the door. The spring hinge of the present invention can also be packagely used together with other two spring hinges having torsion springs to attain the effect of passage fire door function; or it can be packagely used with other two door hinges having clutches thereby achieving the effect to stop door close and close the door at normal stable speed to required angle.

DETAIL DESCRIPTION OF THE PREFERRED EMBODIMENTS

Figure 1:
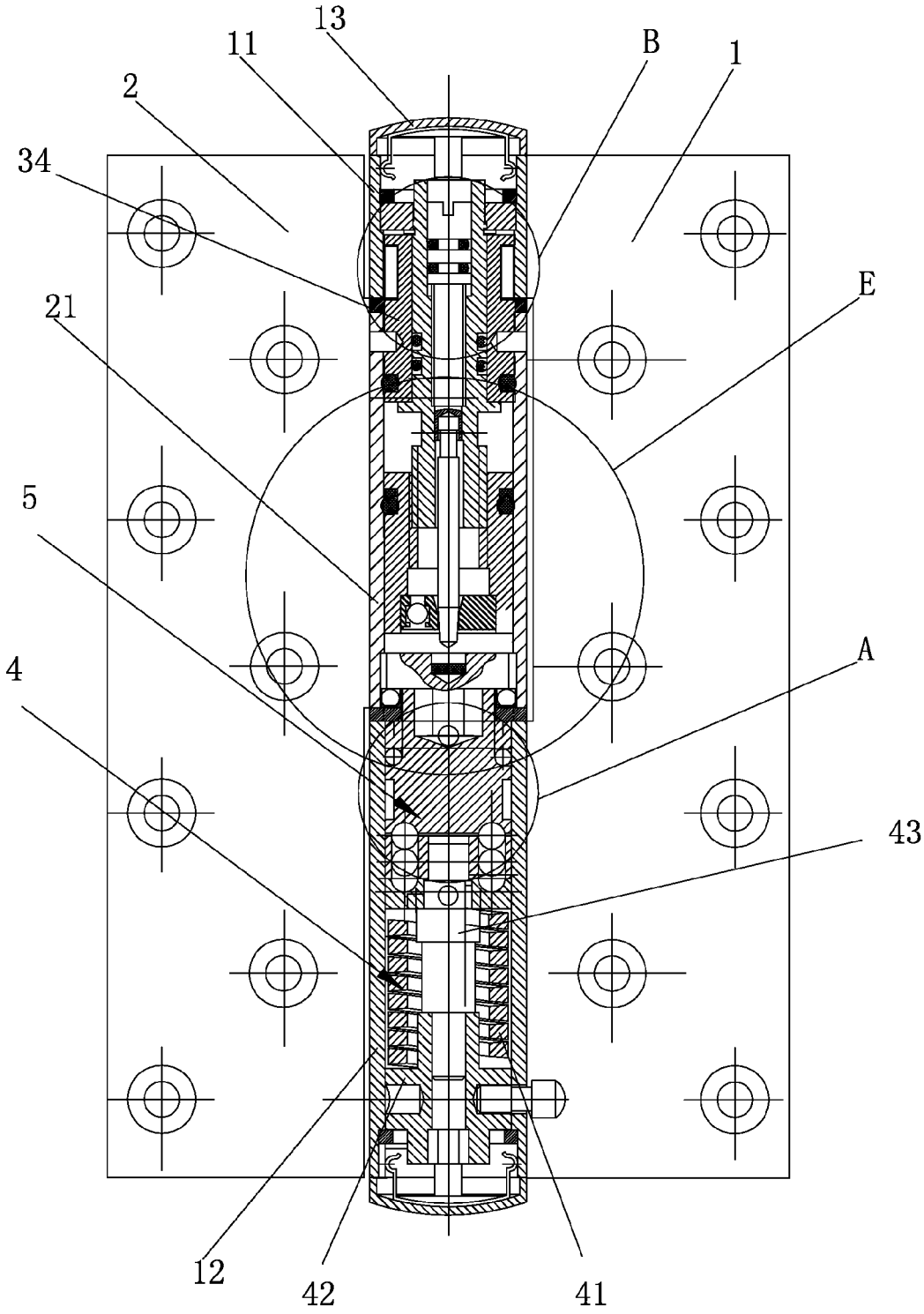
FIG. 1 is an overall assembly view of the embodiment of the invention.
Figure 2:
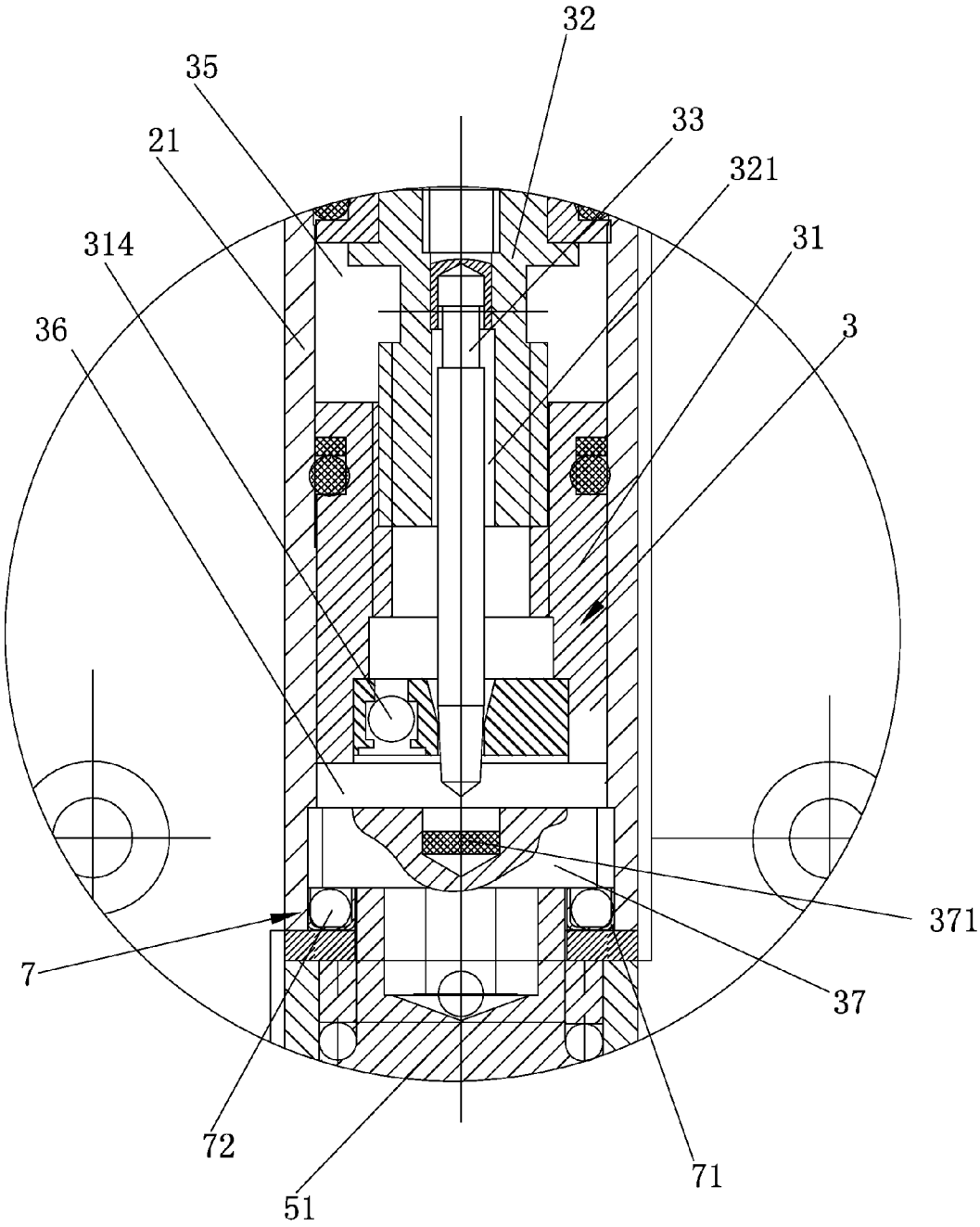
FIG. 2 is a partial enlarged view of part E in FIG. 1.
Figure 3:
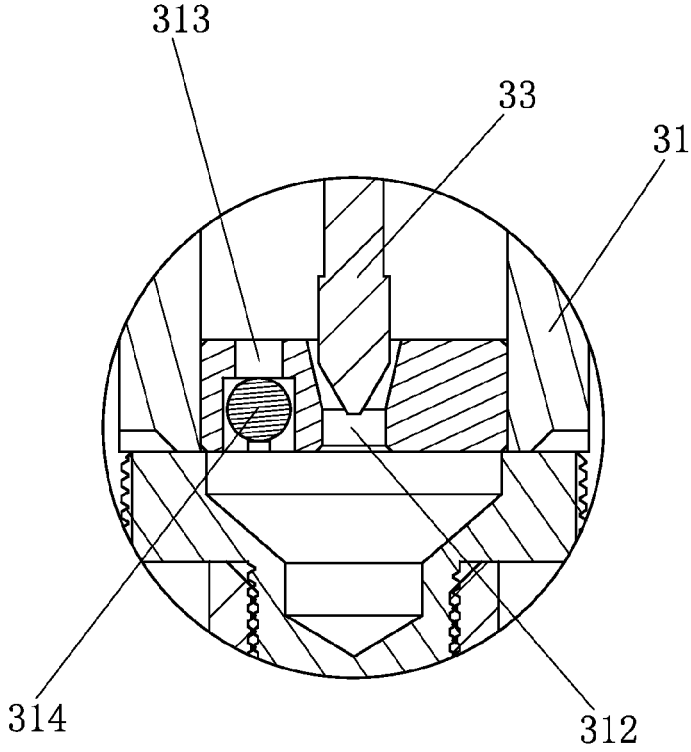
FIG. 3 is an enlarged schematic view of the embodiment of the invention showing the engaged structure between speed adjusting valve and plunger.
Figure 4:
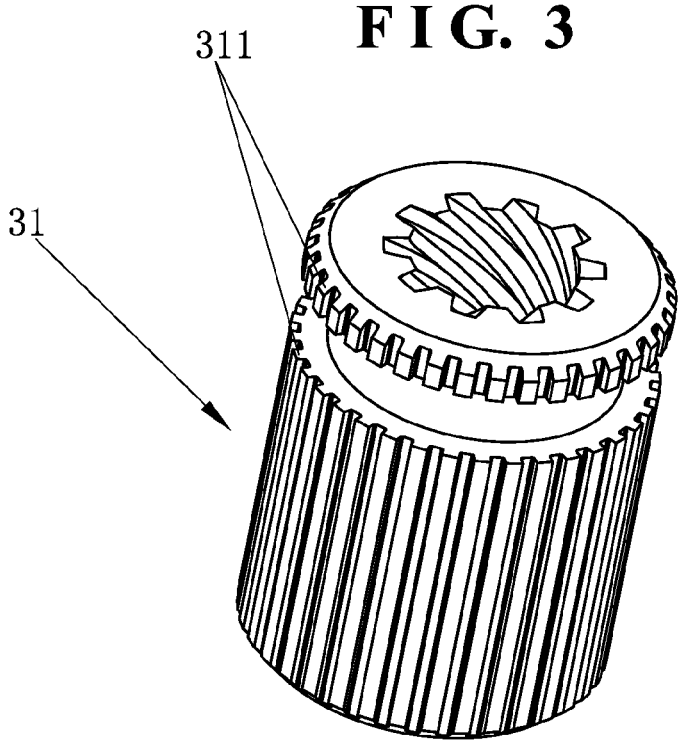
FIG. 4 is a perspective view showing the plunger in the embodiment of the invention.
Figure 5:
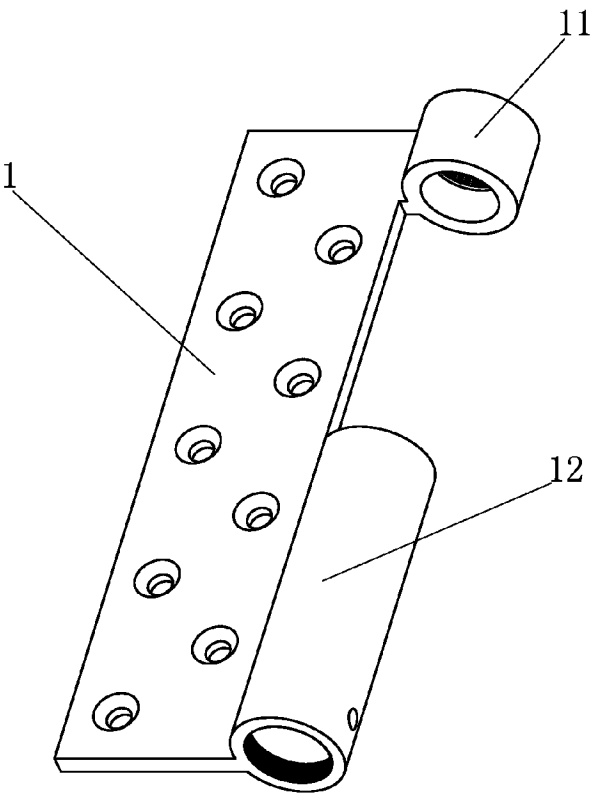
FIG. 5 is a perspective view showing the frame leaf in the embodiment of the invention.
Figure 6:
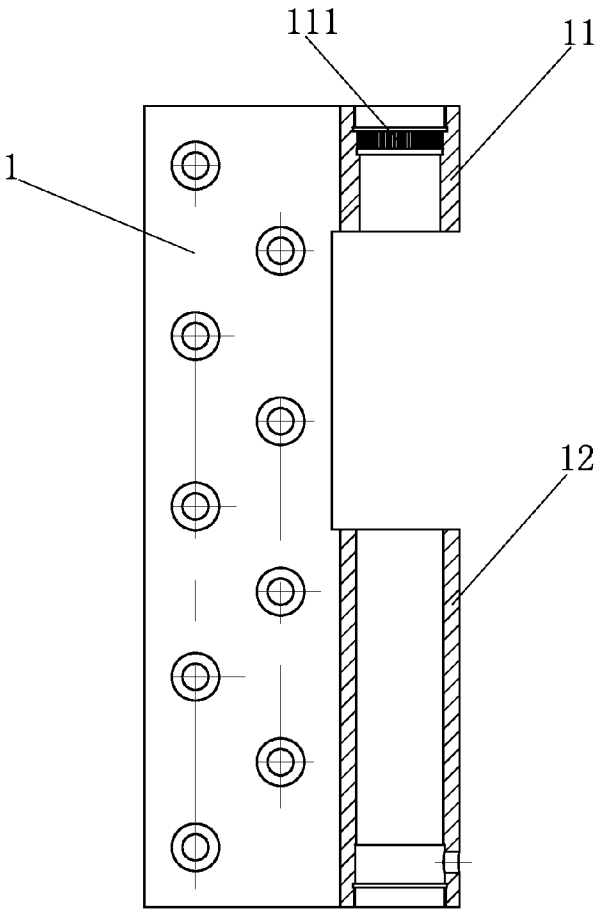
FIG. 6 is a structural schematic view showing the frame leaf in the embodiment of the invention.
Figure 7:
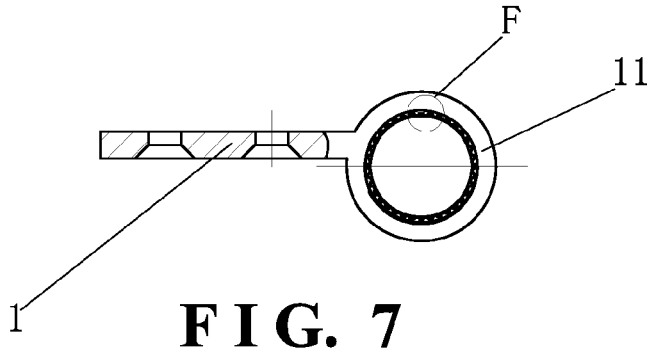
FIG. 7 is a structural schematic top view showing the frame leaf in the embodiment of the invention.
Figure 8:
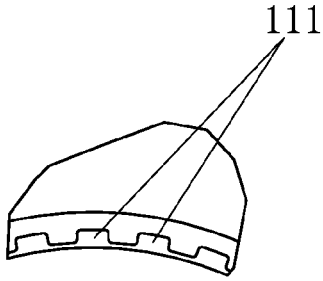
FIG. 8 is an enlarged view of part F in FIG. 7.
Figure 9:
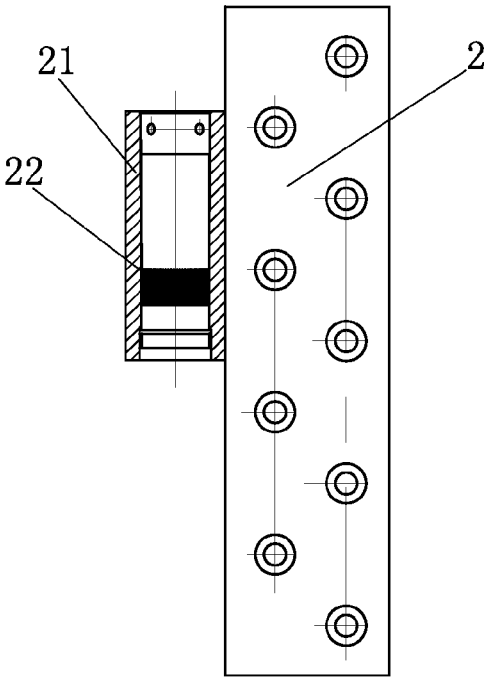
FIG. 9 is a structural schematic view showing the door leaf in the embodiment of the invention.
Figure 10:
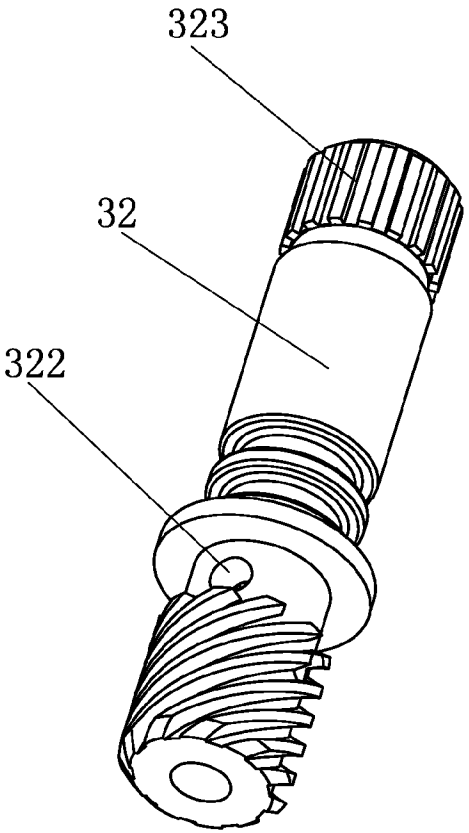
FIG. 10 is a perspective view showing the plunger rod in the embodiment of the invention.
Figure 11:
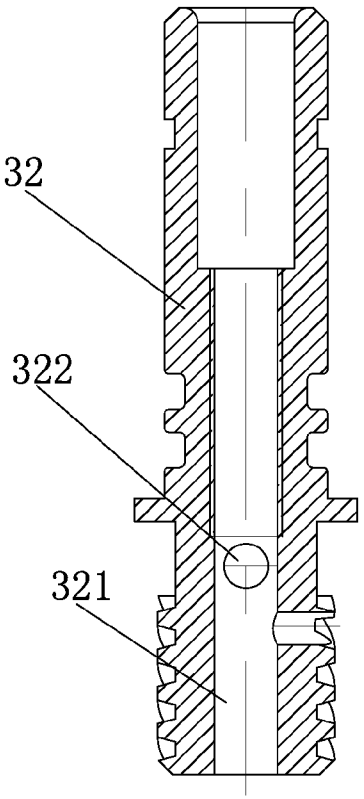
FIG. 11 is a structural schematic view showing the plunger rod in the embodiment of the invention.
Figure 12:
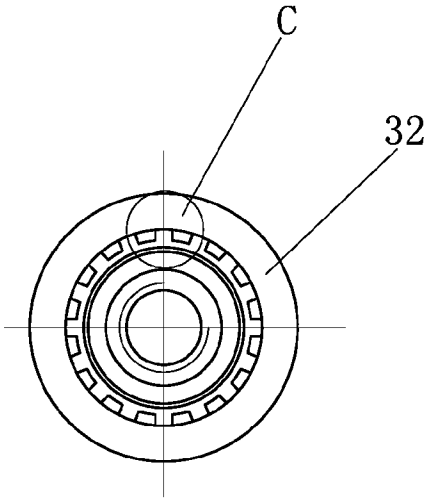
FIG. 12 is a structural schematic top view showing the plunger rod in the embodiment of the invention.
Figure 13:
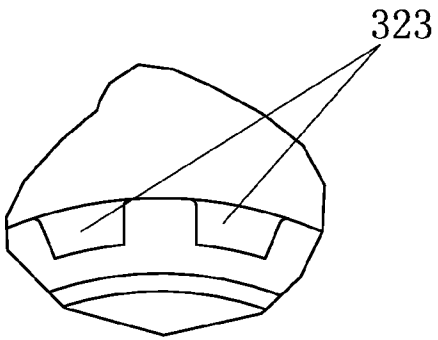
FIG. 13 is an enlarged view of C portion in FIG. 12.
Figure 14:
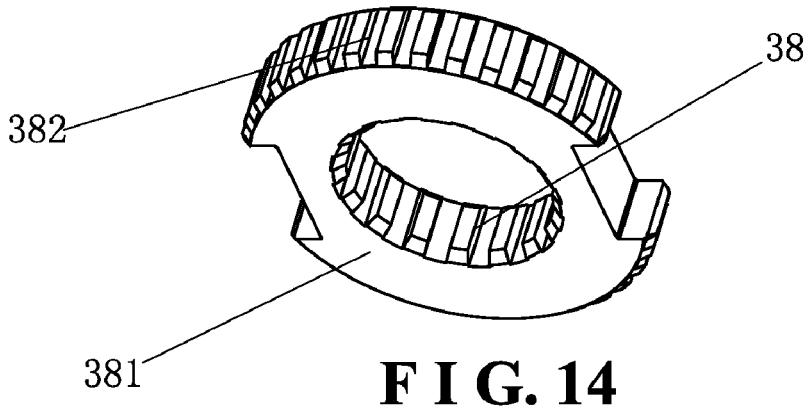
FIG. 14 is a perspective view showing the gear type fixed element in the embodiment of the invention.
Figure 15:
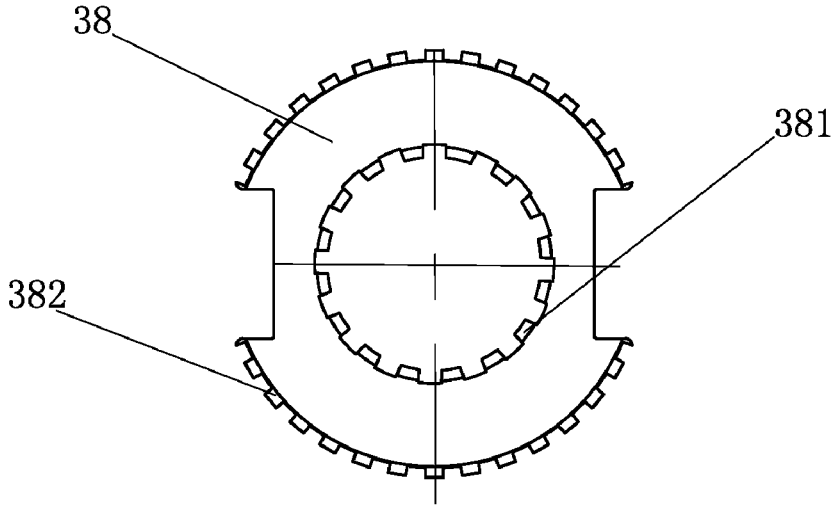
FIG. 15 is a front view showing the gear type fixed element in the embodiment of the invention.
Figure 16:
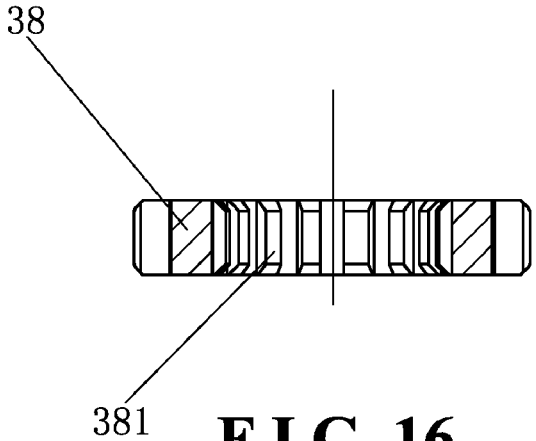
FIG. 16 is a structural schematic side view showing the gear type fixed element in the embodiment of the invention.
Figure 19:
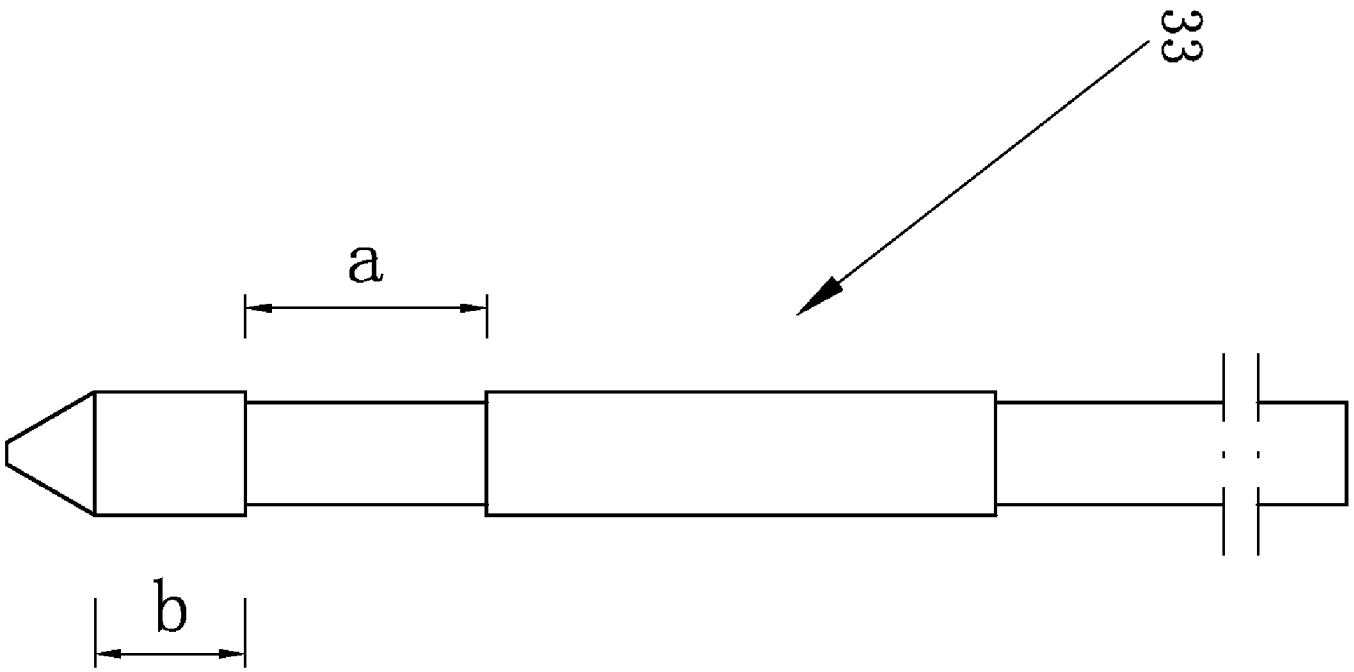
FIG. 19 is an outlook view showing the speed adjusting rod in the embodiment of the invention.
Figure 20:
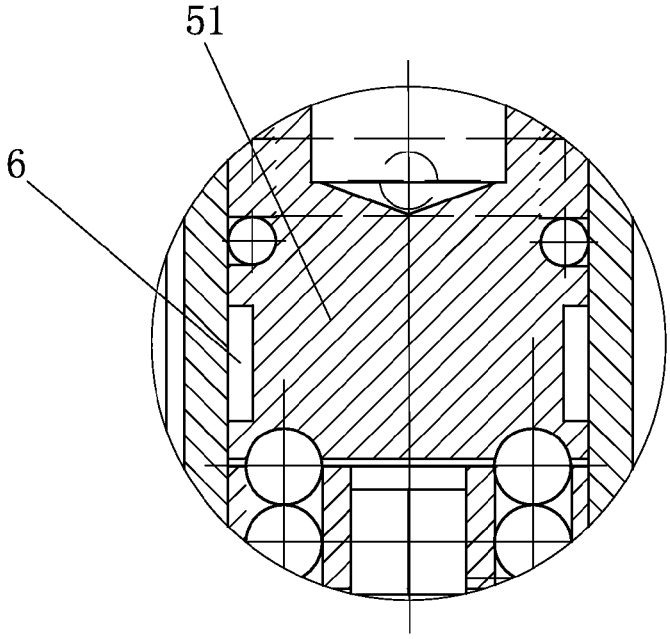
FIG. 20 is an enlarged view of part A in FIG. 1.
Figure 21:
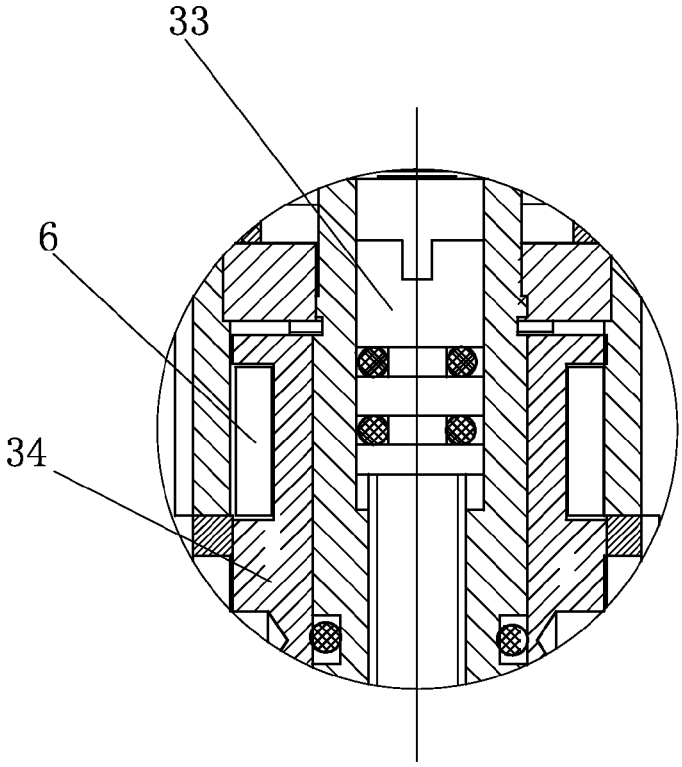
FIG. 21 is an enlarged view of part B in FIG. 1.

As shown in FIG. 1, the specific example for the present invention is a spring hinge comprising a frame leaf 1 (FIGS. 5, 6, 7), door leaf 2, upper and lower tube sections 11, 12 to fixedly connect with frame leaf 1, and the middle tube section 21 to fixedly connect with door leaf 2, wherein middle tube section 21 is internally made with a hydraulic damping speed reducing device 3 (FIG. 2) comprising plunger 31 (FIG. 4), plunger rod 32, speed adjusting rod 33, and plunger rod connecting sleeve 34, plunger 31 being movably sleevedly inserted into middle tube section 21 is radially peripherally uniformly made with multiple guide rails 311 on the external wall of plunger 31, the middle tube section 21 is radially formed with multiple guide grooves 22 on the inner wall thereof to match with guide rails 311 thereby allowing plunger 31 and inner wall of middle tube section 21 to form above said radial linkage connection as well as axial sliding and dynamic sealing engagements; the plunger 31 being internally formed to an inner threaded cavity is respectively made with upper and lower oil cavities 35, 36 at upper and lower ends thereof, further, and further made with oil inlet and oil outlet 312, 313 at lower end portion thereof, wherein oil outlet 313 is formed with an unidirectional valve 314, and plunger rod connecting sleeve 34 is affixed to tube wall of middle tube section 21 (FIGS. 10, 11, 12), wherein upper end of plunger rod 32 being movably sleevedly inserted into plunger rod connecting sleeve 34 and formed with external thread at lower end thereof is inserted into the inner cavity of plunger 31 thereby allowing plunger 31 and plunger rod 32 to form threaded engagement, the plunger rod 32 is centrally penetratingly made with an oil path 321 and is made with a small oil hole 322 in connection with the inner oil path 321 thereof at a position on the external wall thereof relative to upper oil cavity 35, the oil inlet 312 of plunger 31 is centrally located at bottom of plunger 31 to align with said oil path 321 to appear a straight line. The speed adjusting rod 33 being a long spindle is contained inside oil path 321 of plunger rod 32 to threadly connect with plunger rod 32, wherein lower end of speed adjusting rod 33 is inserted into oil inlet 312 of plunger 31 to form adjustable clearance engagement (FIG. 3), further, speed adjusting rod 33 (FIG. 19) has two different cylinder sections at the front end thereof, wherein diameter of cylinder section a is smaller than the one of cylinder section b, upper tube section 11 has an openable top end cover 13, the adjustable end of speed adjusting rod 33 is below top end cover 13, and an oil seal 37 is made at bottom of middle tube section 21 below lower oil cavity 36 and oil seal 37 is sidely made with a magnet 371 relative to plunger 31. The plunger rod 32 is made with radially uniformly distributed multiple rack gear type guide rail 323 on the top part thereof (FIG. 13) and a gear type fixed element 38 (FIGS. 14, 15, 16) is correspondingly provided above top end of plunger rod 32, gear type fixed element 38 is internally ringly formed with gear type grooves 381 to match with gear type guide rail 323 of plunger 32 thereby making guide rails and guide grooves engaged, and the gear type fixed element 38 is further externally ringly formed with radially uniformly distributed multiple gear members 382 thereon to engage with multiple gear grooves 111 being correspondingly made on inner tube wall of upper tube section 11 (FIG. 8), wherein the ratio of number of outer ring gear members to number of inner ring gear type grooves of gear type fixed element 38 is 2.2. The lower tube section 12 is internally installed with a torsion spring device 4 comprising a torsion spring 41 and its spring seat 42 as well as spindle rod 43, wherein torsion spring 41 being completely sleeved on the exterior of spindle rod 43 is affixed to the spring seat 42 at the lower end thereof. An upper and lower clutching device 5 (FIGS. 17, 18) being installed between middle tube section 21 and torsion spring device 4 comprises the axially installed upper clutch seat 51, middle clutch seat 52, and lower clutch seat 53, wherein upper clutch seat 51 is fixedly connected with oil seat 37 of middle tube section 21 at one end thereof, and, middle clutch seat 52 and lower clutch seat 53 are sleeved on spindle rod 43, further, middle clutch seat 52 is radially symmetrically made with two ball holes 521, and each hole contains two matching steel balls 522, the sum of diameters of the two steel balls 522 is larger than the thickness of middle clutch seat 52, wherein ball cavities 54 are disposed, respectively, in between the upper clutch seat and the middle clutch seat, as well as in between the lower clutch seat and the middle clutch seat, to match with steel balls 522 thereon, while depth of ball cavity 54 is smaller than radius of steel ball 522; upper clutch seat 51 is fixedly connected with middle tube section 21, middle clutch seat 52 and lower clutch seat 53 are sleeved on spindle rod 43, middle clutch seat 52 is fixedly connected with spindle rod 43 while lower clutch seat 53 is movably connected with spindle rod 43, upper clutch seat 51 and lower clutch seat 53 are respectively misalignedly rotationally engaged thereby allowing middle tube section 21 and torsion spring device 4 to be separated or combinedly moved (FIG. 20). The upper clutch seat 51 is installed with multiple rollers 6 radially uniformly distributed on the external wall thereof to frictionably engage with inner wall of lower tube section 12 (FIG. 21), and plunger rod connecting sleeve 34 is installed with multiple said rollers 6 radially uniformly distributed on the external wall thereof to frictionally engage with inner wall of middle tube section 21. A steel ball force bearing device 7 being installed between middle tube section 21 and lower tube section 12 comprises steel balls 71, and bearing ball retainer 72 being made at bottom of middle tube section 21 having multiple radially uniformly distributed steel balls 71.

In aforesaid preferred embodiment, middle tube section 21 and plunger 31 are through the guide rail and guide groove engagement to realize up-down translations, while other embodiments can be adopted as long as that plunger 31 is able to perform up-down translations inside middle tube section 21.

In aforesaid preferred embodiment, oil path 321 of upper and lower oil cavities 35, 36 is centrally made inside plunger rod 32, while oil path 321 can be made at other locations as long as that upper and lower oil cavities 35, 36 are interconnected. The speed adjusting rod 33 is preferably contained inside oil path 321, while its mounting location can be correspondingly adjusted according to the position of oil path 321. Speed adjusting rod 33 is threadly engaged with plunger rod 32 for easy adjustment on the width of oil path 321, wherein when speed adjusting rod 33 is threadly rotated to the bottom of threaded section, the space between front end of speed adjusting rod 33 and oil inlet 312 of plunger 31 has the smallest clearance, so oil flow speed is low to realize the door being closed with a slow speed; when speed adjusting rod 33 is threadly rotated to top end of threaded section, the space between front end of speed adjusting rod 33 and oil inlet 312 of plunger 31 is no clearance and the door is closed rapidly.

In aforesaid embodiment, the function of gear type fixed element 38 is used to drive plunger rod 32 for rotation thereby achieving the purpose of adjusting the specific position of plunger 31 inside middle tube section 21, whereas due to that the gear ratio between the two is 2.2, for every degree rotated by gear type fixed element 38, the plunger rod 32 is rotated 2.2 degrees.

Figure 17:
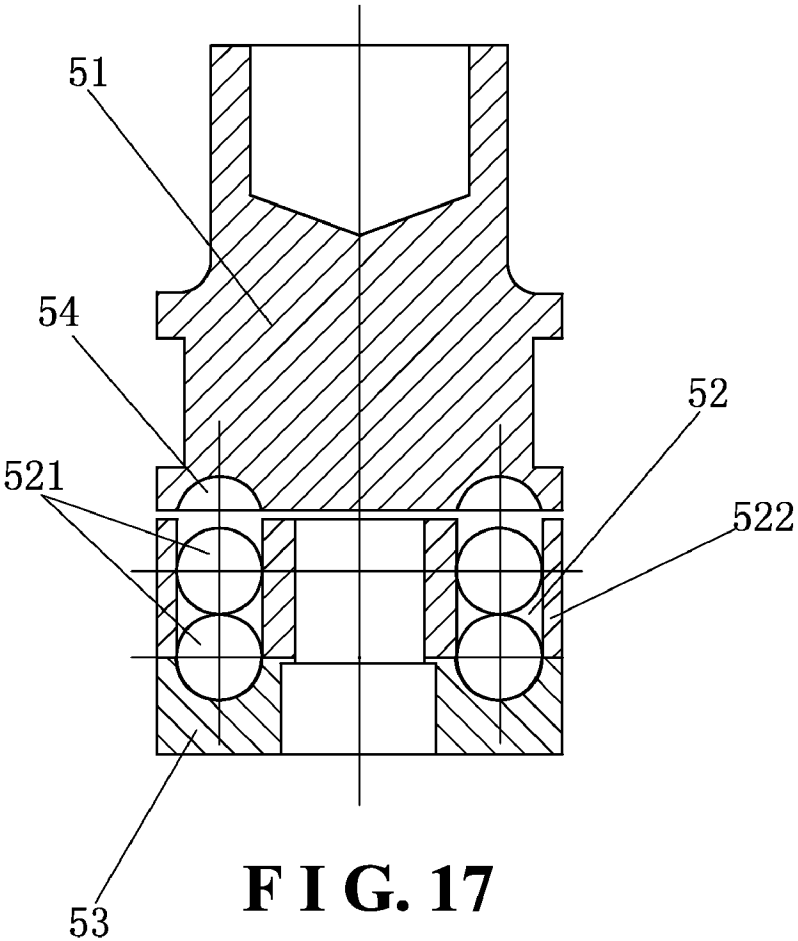
FIG. 17 is the first working status view showing the upper and lower clutching device in the embodiment of the invention.
Figure 18:
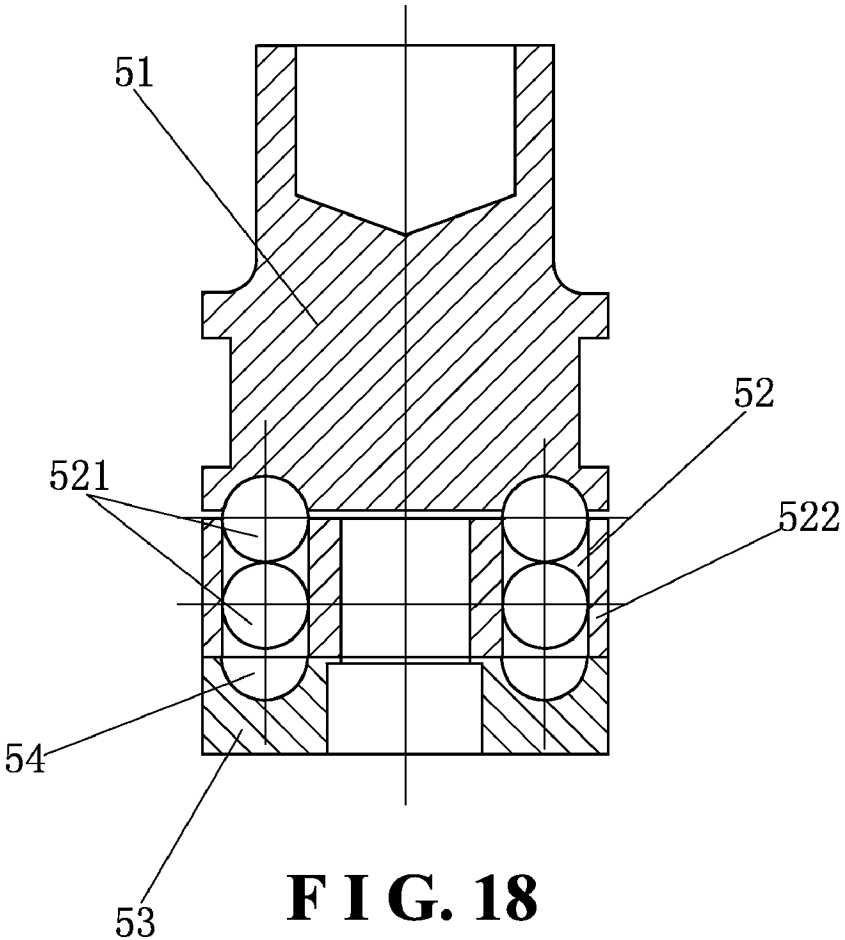
FIG. 18 is the second working status view showing the upper and lower clutching device in the embodiment of the invention.

The work principle between middle tube section 21 and torsion spring device 4 being constituted by the upper and lower clutching device 5 in said embodiment to appear separation or combined movement as shown in FIGS. 17, 18 is: When door is opened, upper clutch seat 51 is rotated along with middle tube section 21, whereas the two steel balls 522 is contained between upper clutch seat 51 and middle clutch seat 52, the middle clutch seat 52 is rotated along with upper clutch seat 51. Further, as middle clutch seat 52 is fixedly connected with spindle rod 43, the spindle rod 43 is forced to drive torsion spring 41 to accumulate energy, while when door is opened to a certain degree of 15-20 degree in general, the steel ball 522 on upper clutch seat 51 is pushed into middle clutch seat 52 to further push underneath steel ball 522 into lower clutch seat 53 simultaneously, and torsion spring 41 is the detached from the rotation of middle tube section to stop accumulating energy; When the door is closed to within 15-20 degree, steel ball 522 at lower clutch seat 53 is driven by torsion spring 41 to coincidentally align with the ball hole 521 of middle clutch seat 52 thereby allowing steel ball 522 to enter middle clutch seat 52 and further to push above steel ball 522 into upper clutch seat 51 simultaneously so as to allow upper clutch seat 51 to connect with middle clutch seat 52 and make torsion spring 41 to release energy thereby driving door leaf 2 strongly to close.

Comparing with existing spring hinge, the present invention is further installed with a hydraulic damping speed reducing device 3 and a torsion spring device 4; when door is opened, the plunger 31 is moved upwardly to push oil inside upper oil cavity 35 to lower oil cavity 36 via unidirectional valve 314, wherein unidirectional valve 314 makes oil flow rapidly without producing resistance. When door is closed, plunger 31 is moved downwardly to push oil inside lower oil cavity 36 to upper oil cavity 35, whereas unidirectional valve 314 is closed, oil can only enter from oil outlet 313 and flow out from small oil hole 322, and since the engaged clearance between speed adjusting rod 33 and oil outlet 313 is small making oil flow slowly thus producing a damping force to resist plunger 31 thereby allowing the door to be closed at a stable speed; when the door is opened within set angle range, the torsion spring device 4 being installed inside lower tube section 12 is driven to accumulate energy and stopped to accumulate energy when the set angle range is exceeded. When the door is closed to the set angle degree, torsion spring 41 starts to release energy thus ensuring a sufficient large force to close the door at final moment and lock in precisely, wherein torsion spring 41 and hydraulic damping speed reducing device 3 are packagely used in the door closing process to allow the door to be slowly closed to a set angle of 15-20 degrees in general, then torsion spring 41 releases energy to precisely close the door. The spring hinge of the present invention can also be packagely used together with other two spring hinges having torsion springs to attain the effect of passage fire door function; or it can be packagely used with other two door hinges having clutches thereby achieving the effect to stop door close and close the door at normal stable speed to required angle.

I claim:

1. A spring hinge comprises a frame leaf, door leaf, upper and lower tube sections to fixedly connect with frame leaf, and the middle tube section to fixedly connect with door leaf, wherein middle tube section is internally made with a hydraulic damping speed reducing device which is characterized in that the lower tube section is internally installed with a torsion spring device comprising a torsion spring and its spring seat as well as spindle rod, wherein torsion spring being completely sleeved on the exterior of spindle rod is affixed to the spring seat at the lower end thereof, and an upper and lower clutching device is installed between middle tube section and torsion spring device thereby allowing middle tube section and torsion spring device to be separated or combinedly moved, wherein the upper and lower clutching device comprises the axially installed upper clutch seat, middle clutch seat, and lower clutch seat, wherein upper clutch seat is fixedly connected with oil seal of middle tube section at one end thereof, wherein middle clutch seat is radially symmetrically made with two ball holes, and each hole contains two matching steel balls, the sum of diameters of the two steel balls is larger than the thickness of middle clutch seat, and ball cavities are disposed, respectively, in between the upper clutch seat and the middle clutch seat, as well as in between the lower clutch seat and the middle clutch seat, to match with steel balls thereon, while depth of ball cavity is smaller than radius of steel ball; further, upper clutch seat is fixedly connected with middle tube section, wherein middle clutch seat and lower clutch seat are sleeved on spindle rod, and middle clutch seat is fixedly connected with spindle rod while lower clutch seat is movably connected with spindle rod.

2. A spring hinge comprises a frame leaf, door leaf, upper and lower tube sections to fixedly connect with frame leaf, and the middle tube section to fixedly connect with door leaf, wherein middle tube section is internally made with a hydraulic damping speed reducing device which is characterized in that the lower tube section is internally installed with a torsion spring device comprising a torsion spring and its spring seat as well as spindle rod, wherein torsion spring being completely sleeved on the exterior of spindle rod is affixed to the spring seat at the lower end thereof, and an upper and lower clutching device is installed between middle tube section and torsion spring device thereby allowing middle tube section and torsion spring device to be separated or combinedly moved, wherein said hydraulic damping speed reducing device comprises plunger, plunger rod, speed adjusting rod, and plunger rod connecting sleeve, wherein plunger is movably sleevedly inserted into middle tube section thereby forming the radial linkage connection as well as axial sliding and dynamic sealing engagement; the plunger is internally formed to an inner threaded cavity and is made with oil cavities respectively at the upper and lower ends thereof and is further made with the oil inlet and oil outlet at lower end portion thereof, wherein oil outlet is formed with an unidirectional valve, and plunger rod connecting sleeve is affixed to tube wall of middle tube section, wherein upper end of plunger rod being movably sleevedly inserted into plunger rod connecting sleeve and formed with external thread at lower end thereof is inserted into the inner cavity of plunger thereby allowing plunger and plunger rod to form threaded engagement; the plunger rod or plunger is centrally penetratingly made with an oil path which is connected with the upper and lower oil cavities; further, the speed adjusting rod being a long spindle is contained inside oil path and is inserted into oil inlet of plunger at the lower end thereof to form adjustable clearance engagement, upper tube section has an openable top end cover, and the adjustable end of speed adjusting rod below the top end cover.

3. The spring hinge as claimed in claim 1, wherein said hydraulic damping speed reducing device comprises plunger, plunger rod, speed adjusting rod, and plunger rod connecting sleeve, wherein plunger is movably sleevedly inserted into middle tube section thereby forming the radial linkage connection as well as axial sliding and dynamic sealing engagement; the plunger is internally formed to an inner threaded cavity and is made with oil cavities respectively at the upper and lower ends thereof and is further made with the oil inlet and oil outlet at lower end portion thereof, wherein oil outlet is formed with an unidirectional valve, and plunger rod connecting sleeve is affixed to tube wall of middle tube section, wherein upper end of plunger rod being movably sleevedly inserted into plunger rod connecting sleeve and formed with external thread at lower end thereof is inserted into the inner cavity of plunger thereby allowing plunger and plunger rod to form threaded engagement; the plunger rod or plunger is centrally penetratingly made with an oil path which is connected with the upper and lower oil cavities; further, the speed adjusting rod being a long spindle is contained inside oil path and is inserted into oil inlet of plunger at the lower end thereof to form adjustable clearance engagement, upper tube section has an openable top end cover, and the adjustable end of speed adjusting rod below the top end cover.

4. The spring hinge as claimed in claim 2, wherein said plunger is radially peripherally uniformly made with multiple guide rails on the external wall thereof, and middle tube section is radially formed with multiple guide grooves on the inner wall thereof to match with guide rails thereby allowing plunger and inner wall of middle tube section to form above said radial linkage connection and axial sliding engagement.

5. The spring hinge as claimed in claim 2, wherein said plunger rod is made with radially uniformly distributed multiple rack gear type guide rail on the top part thereof and a gear type fixed element is correspondingly provided above top end of plunger rod, gear type fixed element is internally ringly formed with gear type grooves to match with gear type guide rail of plunger thereby making guide rails and guide grooves engaged, and the gear type fixed element is further externally ringly formed with radially uniformly distributed multiple gear members thereon to engage with multiple gear grooves being correspondingly made on inner tube wall of upper tube section, wherein number the outer ring gear members and number inner ring gear type grooves of gear type fixed element constitute a corresponding relationship.

6. The spring hinge as claimed in claim 3, wherein said plunger rod is made with radially uniformly distributed multiple rack gear type guide rail on the top part thereof and a gear type fixed element is correspondingly provided above top end of plunger rod, gear type fixed element is internally ringly formed with gear type grooves to match with gear type guide rail of plunger thereby making guide rails and guide grooves engaged, and the gear type fixed element is further externally ringly formed with radially uniformly distributed multiple gear members thereon to engage with multiple gear grooves being correspondingly made on inner tube wall of upper tube section, wherein number the outer ring gear members and number inner ring gear type grooves of gear type fixed element constitute a corresponding relationship.

7. The spring hinge as claimed in claim 2, wherein said plunger rod is centrally penetratingly made with an oil path and is made with a small oil hole in connection with the inner oil path thereof at a position on the external wall thereof relative to oil cavity, the oil inlet of plunger is centrally located at bottom of plunger to align with said oil path to appear a straight line, and the speed adjusting rod is contained inside oil path of plunger rod.

8. The spring hinge as claimed in claim 3, wherein said plunger rod is centrally penetratingly made with an oil path and is made with a small oil hole in connection with the inner oil path thereof at a position on the external wall thereof relative to oil cavity, the oil inlet of plunger is centrally located at bottom of plunger to align with said oil path to appear a straight line, and the speed adjusting rod is contained inside oil path of plunger rod.

9. The spring hinge as claimed in claim 4, wherein said plunger rod is centrally penetratingly made with an oil path and is made with a small oil hole in connection with the inner oil path thereof at a position on the external wall thereof relative to oil cavity, the oil inlet of plunger is centrally located at bottom of plunger to align with said oil path to appear a straight line, and the speed adjusting rod is contained inside oil path of plunger rod.

10. The spring hinge as claimed in claim 2, wherein said middle tube section below lower oil cavity is sidely installed with a magnet at the bottom thereof relative to the plunger.

11. The spring hinge as claimed in claim 3, wherein said middle tube section below lower oil cavity is sidely installed with a magnet at the bottom thereof relative to the plunger.

12. The spring hinge as claimed in claim 1, wherein said upper clutch seat is installed with multiple rollers radially uniformly distributed on the external wall thereof to frictionably engage with inner wall of lower tube section, and plunger rod connecting sleeve is installed with multiple said rollers radially uniformly distributed on the external wall thereof to frictionally engage with inner wall of middle tube section.

13. The spring hinge as claimed in claim 2, wherein said upper clutch seat is installed with multiple rollers radially uniformly distributed on the external wall thereof to frictionably engage with inner wall of lower tube section, and plunger rod connecting sleeve is installed with multiple said rollers radially uniformly distributed on the external wall thereof to frictionally engage with inner wall of middle tube section.

14. A spring hinge comprises a frame leaf, door leaf, upper and lower tube sections to fixedly connect with frame leaf, and the middle tube section to fixedly connect with door leaf, wherein middle tube section is internally made with a hydraulic damping speed reducing device which is characterized in that the lower tube section is internally installed with a torsion spring device comprising a torsion spring and its spring seat as well as spindle rod, wherein torsion spring being completely sleeved on the exterior of spindle rod is affixed to the spring seat at the lower end thereof, and an upper and lower clutching device is installed between middle tube section and torsion spring device thereby allowing middle tube section and torsion spring device to be separated or combinedly moved, wherein a steel ball force bearing device being installed between said middle tube section and lower tube section comprises steel balls, and the bearing ball retainer being made at bottom of middle tube section having multiple radially uniformly distributed steel balls.

15. The spring hinge as claimed in claim 1, wherein a steel ball force bearing device being installed between said middle tube section and lower tube section comprises steel balls, and the bearing ball retainer being made at bottom of middle tube section having multiple radially uniformly distributed steel balls.

16. The spring hinge as claimed in claim 2, wherein a steel ball force bearing device being installed between said middle tube section and lower tube section comprises steel balls, and the bearing ball retainer being made at bottom of middle tube section having multiple radially uniformly distributed steel balls.

* * * * *